US009586078B1

(12) United States Patent
Jones

(10) Patent No.: US 9,586,078 B1
(45) Date of Patent: Mar. 7, 2017

(54) EXERCISE APPARATUS HAVING GUIDED FOOT PAD CARRIERS

(71) Applicant: Thomas Jones, Huntington Beach, CA (US)

(72) Inventor: Thomas Jones, Huntington Beach, CA (US)

(73) Assignee: TCDP, LLC, Huntington Beach, CA (US)

( * ) Notice: Subject to any disclaimer, the term of this patent is extended or adjusted under 35 U.S.C. 154(b) by 283 days.

(21) Appl. No.: 14/304,886

(22) Filed: Jun. 14, 2014

(51) Int. Cl.
*A63B 21/00* (2006.01)
*A63B 21/055* (2006.01)
*A63B 23/04* (2006.01)

(52) U.S. Cl.
CPC ..... *A63B 21/055* (2013.01); *A63B 21/1465* (2013.01); *A63B 21/1488* (2013.01); *A63B 23/04* (2013.01)

(58) Field of Classification Search
CPC ..... A63B 21/00
USPC ..... 482/50, 70, 71
See application file for complete search history.

(56) References Cited

U.S. PATENT DOCUMENTS

| | | | | |
|---|---|---|---|---|
| 7,981,005 | B1 * | 7/2011 | Tsai | A63B 21/055 482/147 |
| D642,639 | S * | 8/2011 | Tsai | D21/689 |
| 9,011,296 | B2 * | 4/2015 | Peralo | A61H 1/02 482/123 |
| 2004/0162193 | A1 * | 8/2004 | Gray | A63B 22/0056 482/70 |
| 2007/0179027 | A1 * | 8/2007 | Van Straaten | A63B 22/14 482/71 |
| 2009/0176631 | A1 * | 7/2009 | Blessing | A63B 22/0061 482/71 |

* cited by examiner

*Primary Examiner* — Jerome W Donnelly
(74) *Attorney, Agent, or Firm* — Barcelo, Harrison & Walker, LLP

(57) ABSTRACT

An apparatus for human exercise includes a first foot pad attached to a first guided carrier member, and a second foot pad attached to a second guided carrier member. Motion of the first and second guided carrier members is limited to linear translation along a longitudinal axis of a horizontal guide rail. First and second and third elastic members may be attached to and apply opposite elastic forces to the first and second guided carrier members along the longitudinal axis. A transverse frame member is fixed to the horizontal guide rail and is oriented horizontally and transverse to the longitudinal axis. A vertical frame member with a raised hand rail may extend from the transverse frame member. The first and second foot pads may be pivotably coupled to the first and guided carrier members by torsional elastic members.

25 Claims, 5 Drawing Sheets

EXERCISE APPARATUS HAVING GUIDED FOOT PAD CARRIERS

BACKGROUND

There are hundreds of different muscles in the human body, and a plethora of other connective tissues and anatomical structures that exercise and stretching might benefit with improved strength and/or mobility. Different stretches or exercises may benefit different subsets of these muscles and connective tissues, with tens of thousands of combinations being possible. Moreover, human fitness can be defined or measured in various ways, many of which are personal and subjective to the exercise apparatus user. Hence, subtle differences in an exercise apparatus may unpredictably change the commercial or practical success of the apparatus.

Many contemporary exercise machines focus on muscle groups that are already well developed in the average user. Other contemporary exercise machines may focus on often under-developed muscle groups, but may invite injury by presenting too much or too little resistance to motion, and/or too easily allow over-stretching of muscles or connective tissue. Other contemporary exercise machines may avoid one or more of the foregoing pitfalls, but at a cost or with complexity that inhibits market acceptance.

Hence there is an ongoing substantial need in the art for improved exercise apparatus designs that can safely improve strength and/or flexibility of connective tissue and muscle combinations that are often under-developed in the average human, with adequate service life and reliability, and that can be practically manufactured at a cost that allows marketability at a profit.

DESCRIPTION OF THE PREFERRED EMBODIMENTS

Figure 1:
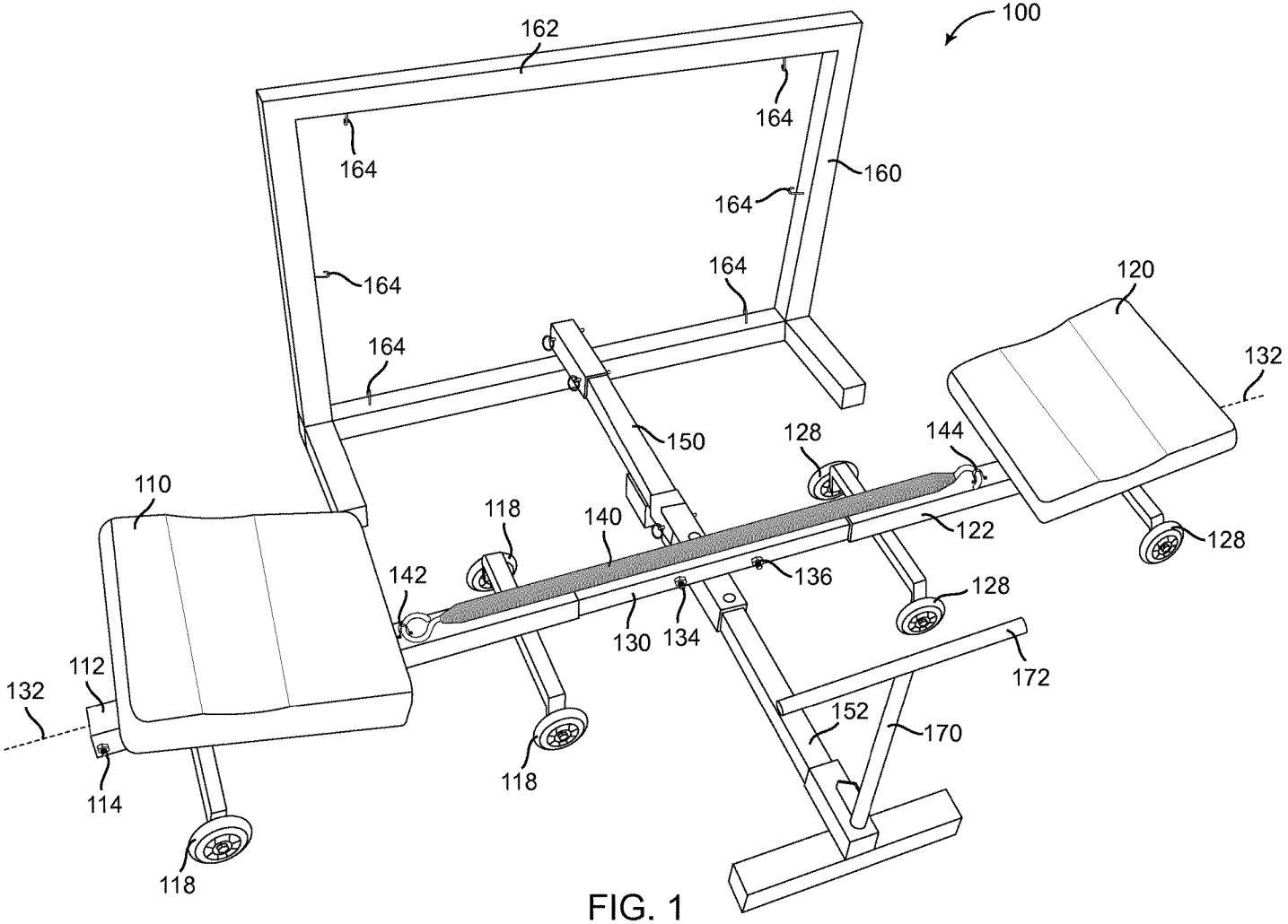
FIG. 1 depicts an apparatus for human exercise according to an example embodiment of the present invention.
Figure 2:
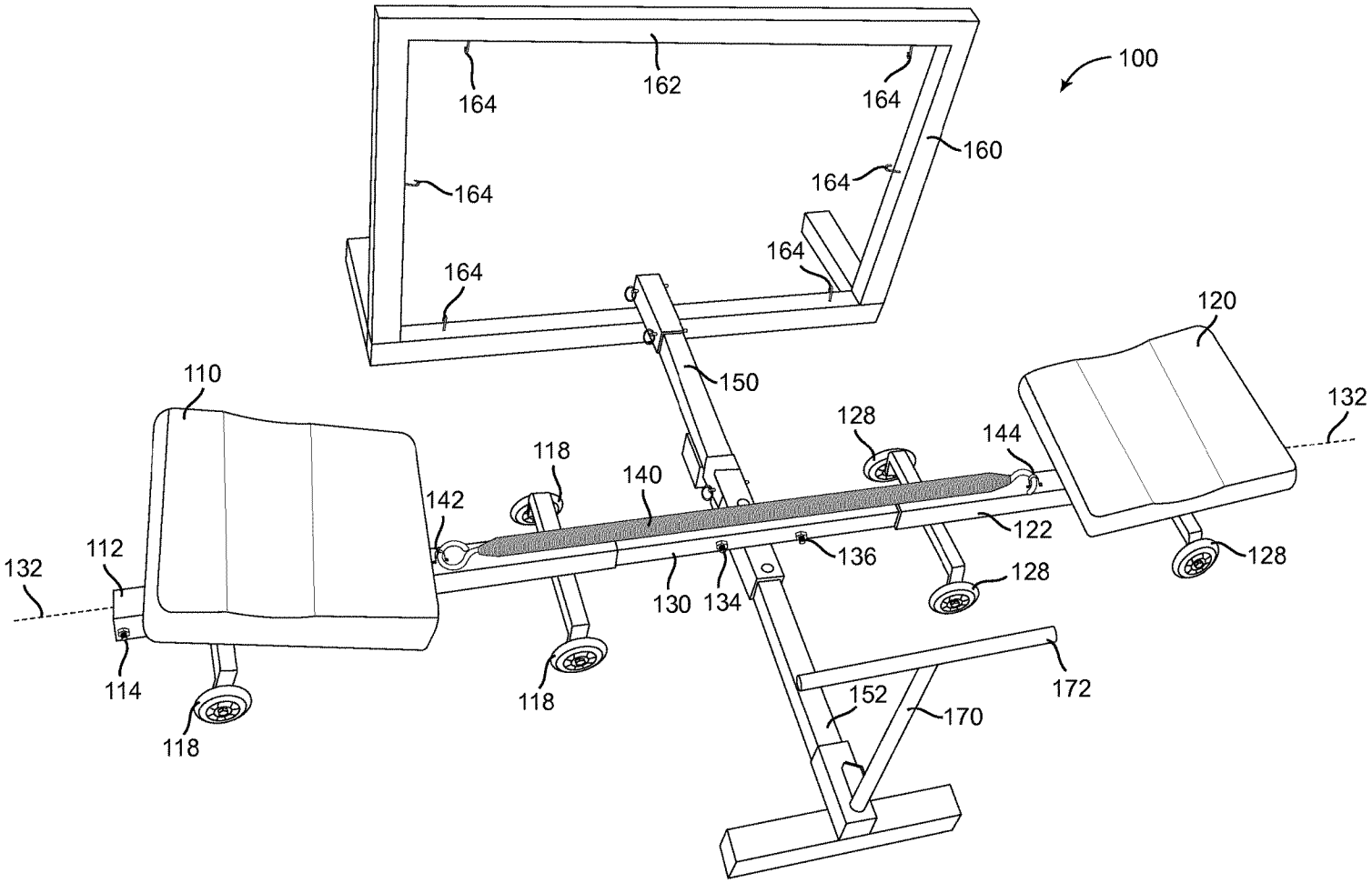
FIG. 2 depicts the apparatus of FIG. 1, in a different configuration.

FIG. 1 depicts an apparatus 100 for human exercise according to an example embodiment of the present invention, that may safely improve strength and/or flexibility of connective tissue and muscle combinations that are often under-developed in the average human user. FIG. 2 depicts the apparatus 100, in an optional alternative configuration that requires marginally more floor space. In the embodiment of FIGS. 1-2, the apparatus 100 includes a first foot pad 110 attached to a first guided carrier member 112, and a second foot pad 120 attached to a second guided carrier member 122. In this context, the first and second foot pads 110, 120 need not be soft or to include a cushion to be referred to herein as a pad, but the first and second foot pads 110, 120 may be hard foot pedals.

In certain embodiments, the first and second foot pads 110. 120 may each optionally be pivotably attached to the first and second guided carrier members 112, 122, respectively, by conventional swivel attachments. In certain embodiments, each of the first and second guided carrier members 112, 122 may optionally include conventional torsional elastic members (e.g. torsional springs) that apply restoring torques to the first and second foot pads 110, 120, respectively. In this context, applying a restoring torque means that if/when the user rotates the foot pad 110 or 120 from a rest angular position, the conventional torsional elastic member torques that foot pad in an opposite sense to tend to return that foot pad to the rest angular position. This may provide an advantageous internal and external rotation resistance to the user of the apparatus 100, for example to facilitate torsional rehabilitation exercises or stretches following hip replacement surgery, etc.

In the embodiment of FIGS. 1-2, the apparatus 100 includes a horizontal guide rail 130 coupled to the first and second guided carrier members 112, 122. For example, in the embodiment of FIGS. 1-2, the horizontal guide rail 130 is nested within the first and second guided carrier members 112, 122. The horizontal guide rail 130 substantially prevents motion of the first and second guided carrier members 112, 122 except for linear translation along a longitudinal axis 132 of the horizontal guide rail 130.

In the embodiment of FIGS. 1-2, the first and second guided carrier members 112, 122 each include a plurality of support wheels 118, 128 configured to roll upon an underlying floor upon which the apparatus 100 rests. In certain embodiments, each of the plurality of support wheels 118, 128 may have an outer diameter that is no less than 1.5 inches (e.g. to facilitate rolling on typical and potentially uneven flooring or ground surfaces).

In certain embodiments, the first and second guided carrier members 112, 122 may optionally include a conventional locking mechanism for selectively immobilizing the first or second guided carrier member 112, 122 with respect to the horizontal guide rail 130. For example, such a conventional locking mechanism may comprise a pin insertable into a hole through the first or second guided carrier member 112, 122 and into the horizontal guide rail 130.

In the embodiment of FIGS. 1-2, the apparatus 100 includes a first elastic member (e.g. a first spring housed inside the horizontal guide rail 130), anchored to and extending from an anchor 134 of the horizontal guide rail 130 to an attachment 114 to the first guided carrier member 112. In the embodiment of FIGS. 1-2 (and as shown in FIGS. 1-2), the anchor 134 is disposed approximately halfway along the total span of the guide rail 130. The first elastic member applies a first elastic force (e.g. to the right in FIGS. 1-2) to the first guided carrier member 112 along the longitudinal axis 132 of the horizontal guide rail 130.

In the embodiment of FIGS. 1-2, the apparatus 100 includes a second elastic member (e.g. a second spring housed inside the horizontal guide rail 130) anchored to and extending from an anchor 136 of the horizontal guide rail 130 to an attachment to the second guided carrier member 122. In the embodiment of FIGS. 1-2 (and as shown in FIGS. 1-2), the anchor 136 is disposed approximately halfway along the total span of the guide rail 130. The second elastic member applies a second elastic force (e.g. to the left in FIGS. 1-2) to the second guided carrier member 122 along the longitudinal axis 132 of the horizontal guide rail 130.

In the embodiment of FIGS. 1-2, the apparatus 100 includes a third elastic member 140 attached to and extending from an attachment 142 to the first guided carrier member 112 to an attachment 144 to the second guided carrier member 122. The third elastic member applies a third elastic force oppositely to both the first and second guided carrier members 112, 122. For example, in the embodiment of FIGS. 1-2, the third elastic member 140, when stretched, applies a rightward force upon the first guided carrier member 112, and a leftward force upon the second guided carrier member 122.

In the embodiment of FIGS. 1-2, the third elastic member 140 is not housed within the horizontal guide rail 130, and so is visible in FIGS. 1-2. Hence, the third elastic member 140 is optionally externally removably attached to the first and second guided carrier members 112, 122. In certain embodiments, a consequence of such external attachment may be that the third elastic force is parallel to but offset from the longitudinal axis 132 of the horizontal guide rail 130 (e.g. by an elastic force offset distance that may be in the range of 0.4 inches to 4 inches). In certain embodiments, the external removable mounting of the third elastic member 140 may provide advantageous selectibility to the user of the apparatus 100.

In certain embodiments, the third elastic member 140 can be selected for a desired additional elastic resistance amount and replaced by the user. For example, the third elastic member 140 may have an elastic coefficient that is less than that of the first elastic member and less than that of the second elastic member. These elastic members may be springs or bungee cords, for example. In this context, the elastic coefficient is the ratio of force to stretch distance from free state. In certain embodiments, the third elastic member 140 preferably may have an elastic coefficient that is less than one third of that of the first elastic member and less than one third of that of the second elastic member.

In the embodiment of FIGS. 1-2, the apparatus 100 includes a transverse frame member 150, 152 fixed to the horizontal guide rail 130. As shown in FIGS. 1-2, the transverse frame member 150, 152 may be oriented horizontally and transverse to the longitudinal axis 132 of the horizontal guide rail 130. The transverse frame member 150, 152 optionally includes a downward facing conventional polymer traction grip for increasing friction with an underlying floor or ground surface upon which the apparatus rests. Note that the flooring or ground is part of the environment of the apparatus 100, and not part of the apparatus 100 itself.

A first vertical frame member 160 may extend vertically from the transverse frame member 150 on a first side of the horizontal guide rail 130, and include a first raised hand rail 162. In this context, to extend vertically requires only that said extension include a substantial vertical component or a predominant vertical component (e.g. >45 degrees from horizontal), not necessarily an extension that is 90° from horizontal. The first raised hand rail 162 is shown in FIGS. 1-2 to be optionally horizontal and fixed, but in an alternative embodiment it may optionally be adjustable by a conventional means (e.g. a pin and series of through holes).

In certain embodiments, the first vertical frame member 160 may optionally include a plurality of anchors 164 (e.g. hooks, eyelets, etc) for selectively attaching a fourth elastic member in various optional configurations. Such a fourth elastic member may be a conventional bungee cord with handles at each end (not shown), for enabling upper body (e.g. arm) exercise—optionally simultaneously with user operation of the foot pads 110, 120.

In the embodiment of FIGS. 1-2, the apparatus 100 may further include a second vertical frame member 170 extending vertically from the transverse frame member 152 on a second side of the horizontal guide rail 130 that is opposite the first side. The second vertical frame member 170 may optionally include a second raised hand rail 172. The second raised hand rail 172 may optionally be adjustable by a conventional means (e.g. a pin and series of through holes), and may optionally be horizontal.

Figure 3:
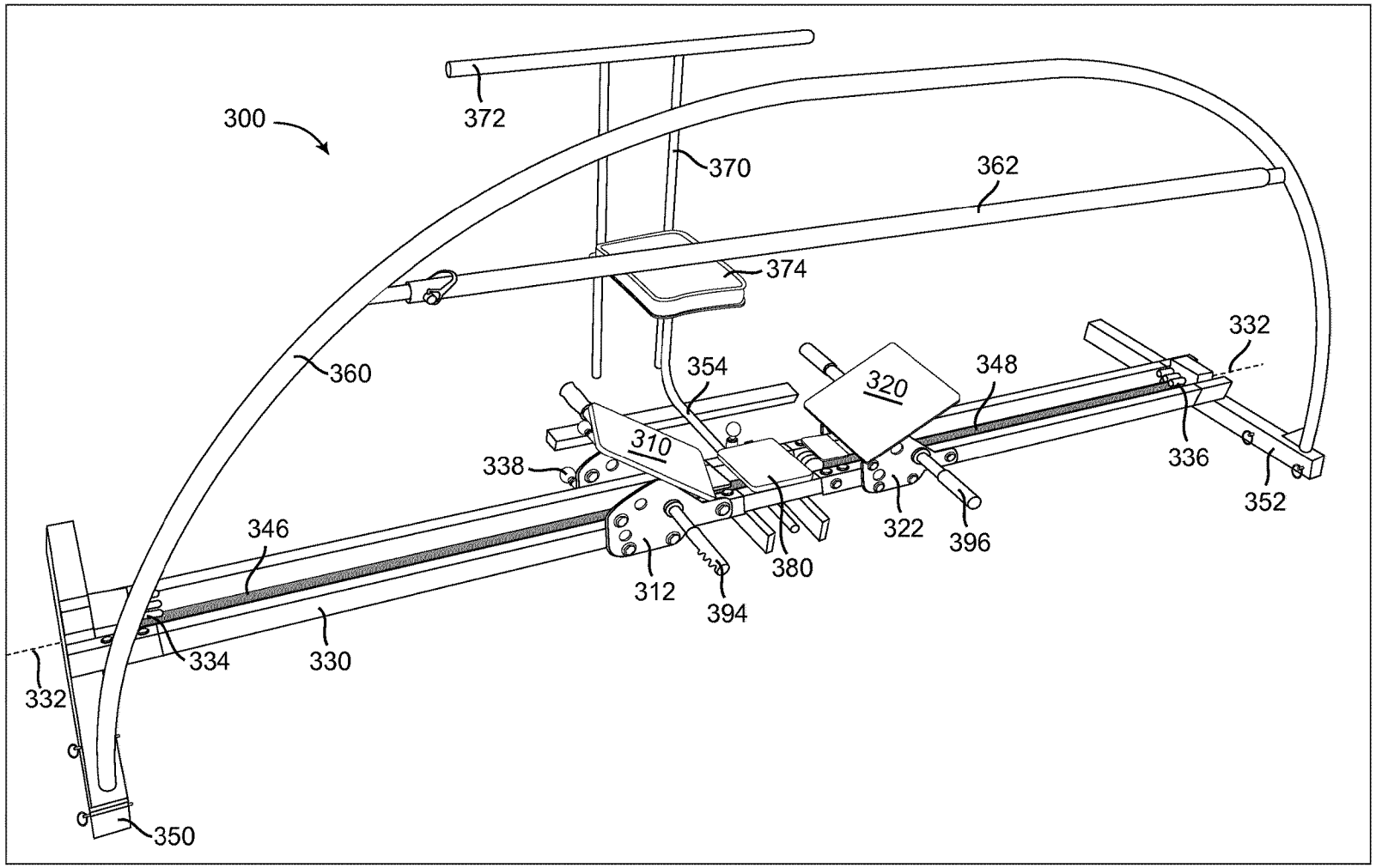
FIG. 3 depicts an apparatus for human exercise according to another example embodiment of the present invention.
Figure 4:
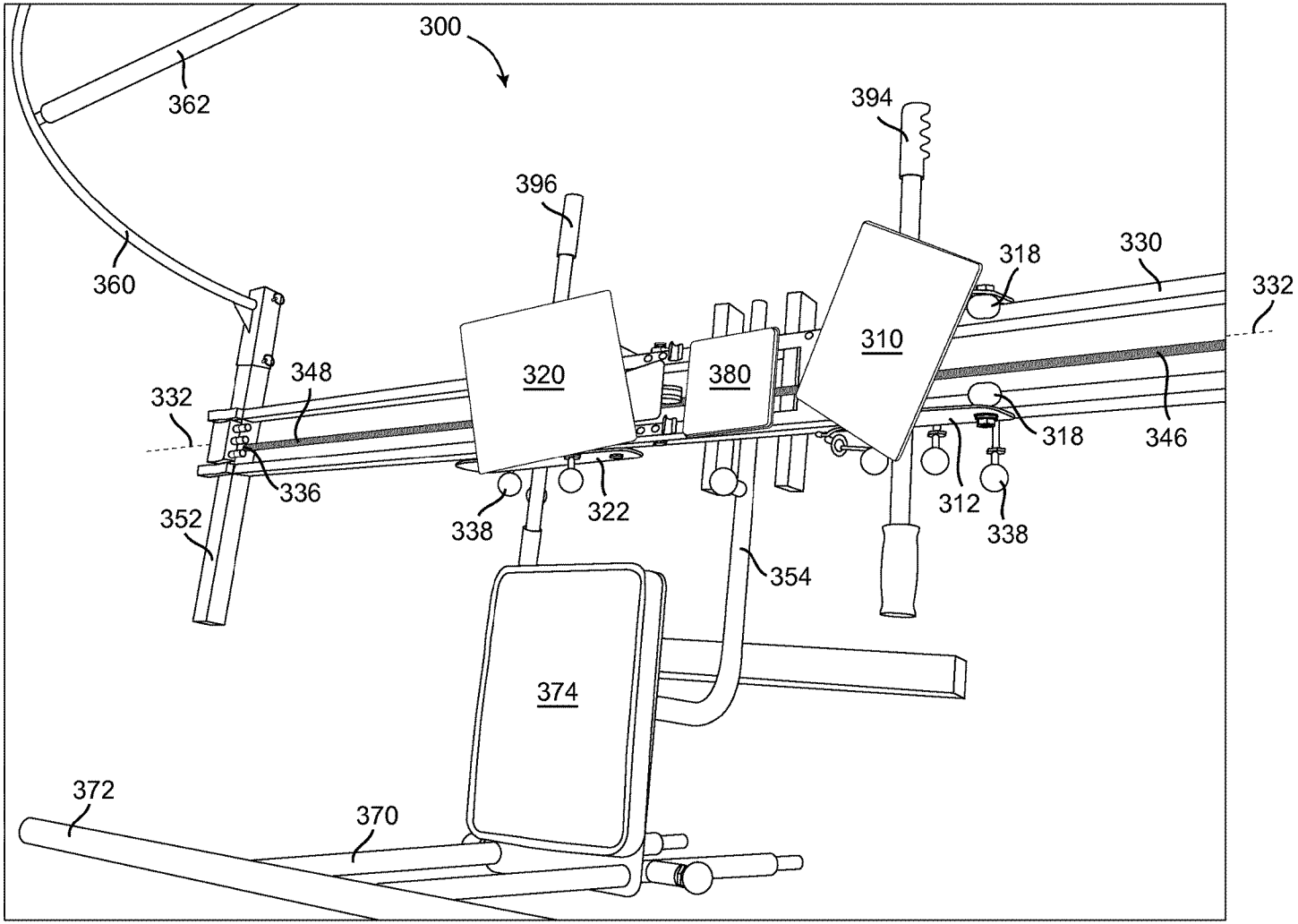
FIG. 4 depicts the apparatus of FIG. 3 from a different perspective.
Figure 5:
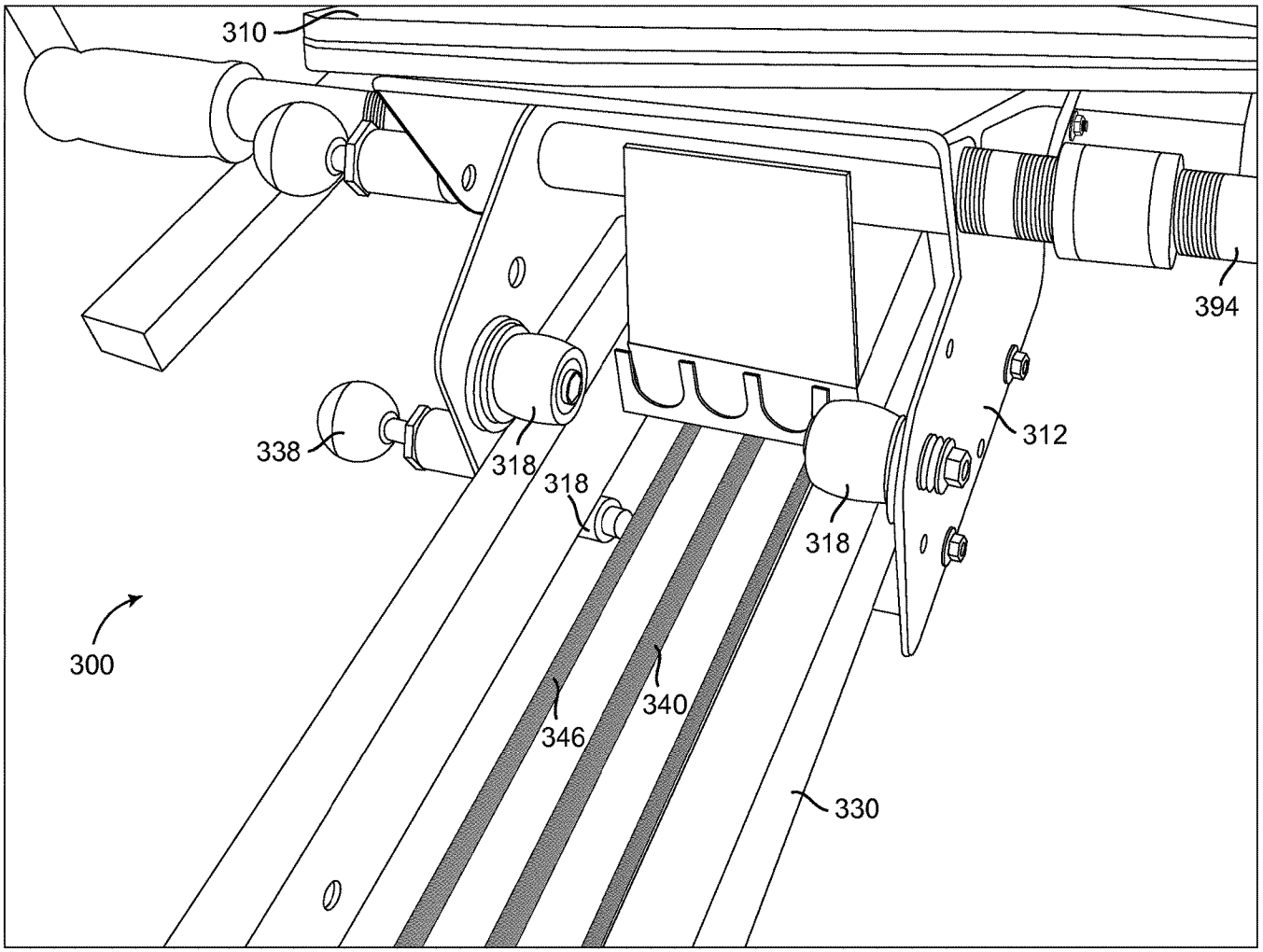
FIG. 5 depicts a portion of the apparatus of FIG. 3.

FIG. 3 depicts an apparatus 300 for human exercise according to another example embodiment of the present invention, that may safely improve strength and/or flexibility of connective tissue and muscle combinations that are often under-developed in the average human user. FIG. 4 depicts the apparatus 300 from a different perspective, and FIG. 5 depicts a portion of the apparatus 300. In the embodiment of FIGS. 3-5, the apparatus 300 includes a first foot pad 310 attached to a first guided carrier member 312, and a second foot pad 320 attached to a second guided carrier member 322. In this context, the first and second foot pads 310, 320 need not be soft or to include a cushion to be referred to herein as a pad, but the first and second foot pads 310, 320 may be hard foot pedals. In certain embodiments, the first and second guided carrier members 312, 322 may optionally further include removable handlebars 394, 396 to facilitate additional exercises or stretches by the user.

In certain embodiments, the first and second foot pads 310. 320 may each optionally be pivotably attached to the first and second guided carrier members 312, 322, respectively, by conventional swivel attachments. In certain embodiments, each of the first and second guided carrier members 312, 322 may optionally include conventional torsional elastic members (e.g. torsional springs) that apply restoring torques to the first and second foot pads 310, 320, respectively. In this context, applying a restoring torque means that if/when the user rotates the foot pad 310 or 320 from a rest angular position, the conventional torsional elastic member torques that foot pad in an opposite sense to tend to return that foot pad to the rest angular position. This may provide an advantageous exercise or stretching resistance to the user of the apparatus 300.

In the embodiment of FIGS. 3-5, the apparatus 300 includes a horizontal guide rail 330 coupled to the first and second guided carrier members 312, 322. For example, in the embodiment of FIGS. 3-5, the horizontal guide rail 330 is nested within the first and second guided carrier members 312, 322. The horizontal guide rail 330 substantially prevents motion of the first and second guided carrier members 312, 322 except for linear translation along a longitudinal axis 332 of the horizontal guide rail 330. Optionally, the apparatus 300 may further include a third foot pad 380 that does not translate and that is fixed to the horizontal guide rail 330 between the first and second foot pads 310, 320. In certain embodiments, the third foot pad 380 may facilitate certain single-leg exercises or stretches.

In the embodiment of FIGS. 3-5, the first and second guided carrier members 312, 322 are each coupled to the horizontal guide rail 330 by a plurality of guide rollers 318 that are attached to the first and second guided carrier members 312, 322. In the embodiment of FIGS. 3-5 the plurality of guide rollers 318 are in contact with the horizontal guide rail 330, but in an alternative embodiment, the plurality of guide rollers 318 may be in contact with an optional ground tray that can be itself supported by the flooring or ground.

In certain embodiments, the first and second guided carrier members 312, 322 may optionally include a locking mechanism for selectively immobilizing the first or second guided carrier member 312, 322 with respect to the horizontal guide rail 130. For example, such a locking mechanism may comprise pins 338 insertable into holes through the first or second guided carrier members 312, 322 and into the horizontal guide rail 330.

In the embodiment of FIGS. 3-5, the apparatus 300 includes a first elastic member 346, anchored to and extending from an anchor 334 of the horizontal guide rail 330 to attach to the first guided carrier member 312 (e.g. optionally after wrapping around a conventional pulley attached to the first guided carrier member 312). The first elastic member 346 applies a first elastic force to the first guided carrier member 312 along the longitudinal axis 332 of the horizontal guide rail 330.

Likewise, a second elastic member 348 may extend from an anchor 336 of the horizontal guide rail 330 to attach to the second guided carrier member 322 (e.g. optionally after wrapping around a conventional pulley attached to the second guided carrier member 332). The second elastic member 348 may apply a second elastic force to the second guided carrier member 322 along the longitudinal axis 332 of the horizontal guide rail 330, for example in an opposite direction relative to the first elastic force.

In the embodiment of FIGS. 3-5, the apparatus 300 optionally includes a third elastic member 340 attached to and extending from the first guided carrier member 312 to the second guided carrier member 322. The third elastic member may apply a third elastic force oppositely to both the first and second guided carrier members 312, 322. In certain embodiments, one or more of the first, second, and third elastic members 346, 348, 340 can be selected for a desired additional elastic resistance amount and replaced by the user, which may provide advantageous selectibility to the user of the apparatus 300. The elastic members 346, 348, 340 may be springs or bungee cords, for example.

In the embodiment of FIGS. 3-5, the apparatus 300 include transverse frame members 350, 352 fixed to the horizontal guide rail 330. As shown in FIGS. 3-5, the transverse frame members 350, 352 may be oriented horizontally and transverse to the longitudinal axis 332 of the horizontal guide rail 330. The transverse frame members 350, 352 optionally include a downward facing conventional polymer traction grip for increasing friction with an underlying floor or ground surface upon which the apparatus rests. Note that the flooring or ground is part of the environment of the apparatus 300, and not part of the apparatus 300 itself.

A first vertical frame member 360 may extend vertically from the transverse frame members 350, 352 on a first side of the horizontal guide rail 330, and include a first raised hand rail 362. In this context, to extend vertically requires only that said extension include a portion having a substantial vertical component or a predominant vertical component (e.g. >45 degrees from horizontal), not necessarily an extension that is 90° from horizontal. The first raised hand rail 362 is shown in FIGS. 3-5 to be optionally horizontal and fixed, but in an alternative embodiment it may optionally be adjustable by a conventional means (e.g. a pin and series of through holes).

In certain embodiments, the first vertical frame member 360 may optionally include a plurality of anchors (e.g. hooks, eyelets, etc) for selectively attaching a fourth elastic member in various optional configurations. Such a fourth elastic member may be a conventional bungee cord with handles at each end (not shown), for enabling upper body (e.g. arm) exercise—optionally simultaneously with user operation of the foot pads 310, 320.

In the embodiment of FIGS. 3-5, the apparatus 300 may further include a second vertical frame member 370 extending vertically from a transverse frame member 354 on a second side of the horizontal guide rail 330 that is opposite the first side. The second vertical frame member 370 may optionally include a second raised hand rail 372. The second raised hand rail 372 may optionally be adjustable by a conventional means (e.g. a pin and series of through holes), and may optionally be horizontal. In certain embodiments, the second vertical frame member 370 may optionally also include a seat 374. In the embodiment of FIGS. 3-5, the seat 374 is optionally configured to support a human user of the apparatus 300 in a sitting position with her feet in contact with the first and second foot pads 310, 320.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

What is claimed is:

1. An apparatus for human exercise comprising:

a first foot pad attached to a first guided carrier member, and a second foot pad attached to a second guided carrier member;

a horizontal guide rail coupled to the first and second guided carrier members, the horizontal guide rail preventing motion of the first and second guided carrier members except for linear translation along a longitudinal axis of the horizontal guide rail;

a first elastic member anchored to and extending from the horizontal guide rail to an attachment to the first guided carrier member, the first elastic member applying a first elastic force to the first guided carrier member along the longitudinal axis of the horizontal guide rail;

a second elastic member anchored to and extending from the horizontal guide rail to an attachment to the second guided carrier member, the second elastic member applying a second elastic force to the second guided carrier member along the longitudinal axis of the horizontal guide rail and in an opposite direction relative to the first elastic force;

a third elastic member attached to and extending from the first guided carrier member to an attachment to the second guided carrier member, the third elastic member applying a third elastic force oppositely to both the first and second guided carrier members;

a transverse frame member fixed to the horizontal guide rail, the transverse frame member being oriented horizontally and transverse to the longitudinal axis of the horizontal guide rail; and a first vertical frame member extending vertically from the transverse frame member on a first side of the horizontal guide rail, the first vertical frame member including a first raised hand rail.

2. The apparatus of claim 1 wherein the horizontal guide rail has a total guide rail span, and the first elastic member is anchored to the horizontal guide rail approximately halfway along the total guide rail span.

3. The apparatus of claim 1 wherein the third elastic force is parallel to but offset from the longitudinal axis of the horizontal guide rail by an elastic force offset distance that is in the range of 0.4 inches to 4 inches.

4. The apparatus of claim 1 wherein the first guided carrier member further includes a handlebar.

5. The apparatus of claim 1 further comprising a second vertical frame member extending vertically from the transverse frame member on a second side of the horizontal guide rail that is opposite the first side, the second vertical frame member including a second raised hand rail.

6. The apparatus of claim 1 wherein a height of the first raised hand rail above the transverse frame member is adjustable.

7. The apparatus of claim 1 wherein the first, second, and third elastic members are springs.

8. The apparatus of claim 1 further comprising a third foot pad that does not translate and that is fixed to the horizontal guide rail between the first and second foot pads.

9. The apparatus of claim 1 wherein the third elastic member has an elastic coefficient that is less than that of the first elastic member and less than that of the second elastic member.

10. The apparatus of claim 1 wherein first and second guided carrier members include a plurality of support wheels configured to roll upon an underlying floor upon which the apparatus rests, each of the plurality of support wheels having an outer diameter that is no less than 1.5 inches.

11. The apparatus of claim 1 wherein the third elastic member is externally removably attached to the first and second guided carrier members.

12. The apparatus of claim 1 wherein the first and second guided carrier members are coupled to the horizontal guide rail by a plurality of guide rollers that are attached to the first and second guided carrier members.

13. The apparatus of claim 1 wherein the horizontal guide rail is nested within the first and second guided carrier members, and the first and second elastic members are housed within the horizontal guide rail, and the third elastic member is not housed within the horizontal guide rail.

14. The apparatus of claim 1 wherein the transverse frame member includes a downward facing polymer traction grip for increasing friction with an underlying floor upon which the apparatus rests.

15. The apparatus of claim 5 wherein the second vertical frame member includes a seat, the seat configured to support a human user of the apparatus in a sitting position with her feet in contact with the first and second foot pads.

16. The apparatus of claim 1 wherein the first foot pad is pivotably attached to the first guided carrier member by a first swivel attachment, and the second foot pad is pivotably attached to the second guided carrier member by a second swivel attachment.

17. The apparatus of claim 1 wherein the first guided carrier member includes a first locking mechanism for selectively immobilizing the first guided carrier member with respect to the horizontal guide rail, and the second guided carrier member includes a second locking mechanism for selectively immobilizing the second guided carrier member with respect to the horizontal guide rail.

18. The apparatus of claim 17 wherein the first locking mechanism comprises a first pin insertable into a first hole through the first guided carrier member and the horizontal guide rail, and the second locking mechanism comprises a second pin insertable into a second hole through the second guided carrier member and the horizontal guide rail.

19. The apparatus of claim 1 further comprising a fourth elastic member having two handles, one at each of two ends of the fourth elastic member, and wherein the first vertical frame member includes a plurality of anchors for selectively attaching the fourth elastic member.

20. An apparatus for human exercise comprising:

a first foot pad attached to a first guided carrier member, and a second foot pad attached to a second guided carrier member;

a horizontal guide rail coupled to the first and second guided carrier members, the horizontal guide rail preventing motion of the first and second guided carrier members except for linear translation along a longitudinal axis of the horizontal guide rail;

a first elastic member attached to and applying a first elastic force to the first guided carrier member along the longitudinal axis of the horizontal guide rail;

a second elastic member attached to and applying a second elastic force to the second guided carrier member along the longitudinal axis of the horizontal guide rail and in an opposite direction relative to the first elastic force;

a transverse frame member fixed to the horizontal guide rail, the transverse frame member being oriented horizontally and transverse to the longitudinal axis of the horizontal guide rail; and a first vertical frame member extending vertically from the transverse frame member on a first side of the horizontal guide rail, the first vertical frame member including a first raised hand rail;

wherein the first foot pad is pivotably attached to the first guided carrier member by a first swivel attachment, the first guided carrier member including a first torsional elastic member that applies a first restoring torque to the first foot pad, and the second foot pad is pivotably attached to the second guided carrier member by a second swivel attachment, the second guided carrier member including a second torsional elastic member that applies a second restoring torque to the second foot pad.

21. The apparatus of claim 20 further comprising a third foot pad that does not translate and that is fixed to the horizontal guide rail between the first and second foot pads.

22. The apparatus of claim 20 wherein the first guided carrier member includes a first locking mechanism for selectively immobilizing the first guided carrier member with respect to the horizontal guide rail, and the second guided carrier member includes a second locking mechanism for selectively immobilizing the second guided carrier member with respect to the horizontal guide rail.

23. The apparatus of claim 20 wherein the first and second guided carrier members are coupled to the horizontal guide rail by a plurality of guide rollers that are attached to the first and second guided carrier members.

24. The apparatus of claim 20 wherein first and second guided carrier members include a plurality of support wheels configured to roll upon an underlying floor upon which the apparatus rests.

25. The apparatus of claim 20 wherein each of the first and second guided carrier members includes a handlebar.

* * * * *